US008110973B2

(12) United States Patent
Richard et al.

(10) Patent No.: US 8,110,973 B2
(45) Date of Patent: Feb. 7, 2012

(54) INTEGRALLY BALLASTED LAMP ASSEMBLY INCLUDING A SPACER DISK

(76) Inventors: Renaud Richard, Manchester, NH (US); Louie Veiga, Nashua, NH (US); Randall Brown, Barrington, NH (US); Harold L. Rothwell, Jr., Hopkinton, NH (US)

( * ) Notice: Subject to any disclaimer, the term of this patent is extended or adjusted under 35 U.S.C. 154(b) by 213 days.

(21) Appl. No.: 12/661,397

(22) Filed: Mar. 16, 2010

(65) Prior Publication Data

US 2011/0227471 A1 Sep. 22, 2011

(51) Int. Cl.
*H01J 5/16* (2006.01)
*F21V 7/00* (2006.01)

(52) U.S. Cl. ..... 313/318.09; 313/113; 313/318.05; 313/318.11; 362/296.01; 445/23

(58) Field of Classification Search ..... None
See application file for complete search history.

(56) References Cited

U.S. PATENT DOCUMENTS 5,057,735 A 10/1991 Zalar et al.
5,272,409 A 12/1993 Van Dulmen et al.
5,595,438 A * 1/1997 Burd ..... 362/228
5,629,581 A 5/1997 Belle et al.
5,751,095 A 5/1998 Zalar
5,855,430 A * 1/1999 Coushaine et al. ..... 362/519
6,162,096 A 12/2000 Klaus
6,893,143 B2 * 5/2005 Opolka ..... 362/241
7,227,308 B2 6/2007 Rense
2004/0120148 A1 6/2004 Morris et al.
2005/0213332 A1 9/2005 Kendrick et al.
2008/0259594 A1 * 10/2008 Maglica ..... 362/202
2009/0279310 A1 11/2009 Freeman et al.

* cited by examiner

*Primary Examiner* — Ashok Patel
(74) *Attorney, Agent, or Firm* — Edward S. Podszus

(57) ABSTRACT

An integrally ballasted lamp assembly (200) including a spacer disk (220) disposed in a lamp receptacle cavity (244) between a lamp (226) and the bottom (238) of the lamp receptacle (214). The disk (220) may be configured to contact connector clips (216, 218) coupled to the bottom (238) of the lamp receptacle to positively align the clips (216, 218) for connection to a ballast circuit disposed on a PCB (212). The disk (220) may also, or alternatively, at least partially occlude connector clip openings (402, 404) in the bottom (238) of the lamp receptacle (214) for hindering the flow of uncured cement (902) through the openings (402, 404), and may also, or alternatively, provide a thermal barrier between the lamp (226) and the lamp receptacle (214).

14 Claims, 7 Drawing Sheets

INTEGRALLY BALLASTED LAMP ASSEMBLY INCLUDING A SPACER DISK

TECHNICAL FIELD

The present application relates to an integrally ballasted lamp assembly including a spacer disk.

BACKGROUND

The use of gas discharge lamps, such as high intensity discharge (HID) lamps, is common in a wide variety of applications. A gas discharge lamp operates in a fundamentally different way than an incandescent lamp, and therefore may not be directly connectable to existing lighting fixtures designed for incandescent lamps. To allow use of a gas discharge lamp with existing lighting fixtures, integrally ballasted gas discharge lamp assemblies have been developed. In an integrally ballasted lamp assembly, a ballast circuit is provided within the lamp housing and the lamp housing is configured to directly connect to existing lighting fixtures. In general, the ballast circuit receives an electrical input, e.g. an alternating current (A.C.) or direct current (D.C.) input, from the existing lighting fixture and provides a stable output to the gas discharge lamp.

One example of a known integrally ballasted lamp assembly 100 is illustrated in FIG. 1. In the embodiment shown in FIG. 1, the assembly includes a screw shell 102, a housing 104, a heat sink/EMI shield 106, a printed circuit board (PCB) with a ballast circuit thereon 108, a lamp receptacle 110, connector clips 112,114, a glass reflector 116, a gas discharge lamp 118, a support disk 120 and a lens 122. In general, the PCB with the ballast circuit thereon 108 is provided within the housing 104 and is electrically connected to the screw shell 102, which is sometimes referred to as an Edison connector. The screw shell is configured to be received within an existing light fixture through threaded engagement of the threads on the screw shell with corresponding threads on the existing lighting fixture. An electrical input is thereby coupled from the lighting fixture to the ballast circuit on the PCB through the screw shell.

The heat sink/EMI shield 106 may be provided in first and second parts that are fastened around the PCB 108 and mechanically coupled thereto. Heat generated by the ballast circuit during operation is dissipated by the heat sink/EMI shield 106. The heat sink/EMI shield also provides shielding of electro-magnetic interference (EMI) from the ballast circuit on the PCB.

The lamp receptacle 110 may include a bottom portion having connector clip openings therein. The connector clips 112, 114 are inserted into the connector clip openings and secured to the bottom of the lamp receptacle in a snap-fit manner so that a portion of the connector clips extends outwardly from the bottom of the lamp receptacle. The PCB 108 is positioned adjacent to the bottom of the lamp receptacle and the connector clips each make a spring contact with an associated contact on the PCB board 108. This provides an electrical connection from contacts on the PCB board to each of the connector clips.

The glass reflector 116 has a bottom portion disposed in an open end of the lamp receptacle 110 and is mechanically supported by the lamp receptacle. A bottom portion of the lamp 118 extends through a through-passage in the reflector 116 and into the lamp receptacle 110. The electrical leads of the lamp extend through the connector clip openings in the bottom of the lamp receptacle and in contact with the respective connector clips 112,114. The lamp leads may then be welded to the respective connector clips to make an electrical connection between the lamp leads and contacts on the PCB board through the connector clips that are snap fit to the bottom of the lamp receptacle.

To complete the assembly, the open end of the reflector 116 may be closed by the lens 122, e.g. using a bezel, and the top of the lamp 118 may be supported against the interior surface of the reflector by the support disk 120. One example of an integrally ballasted lamp similar to that shown in FIG. 1 is shown and described in U.S. Patent Application Publication No. US 2009/0279310, the teachings of which are hereby incorporated herein by reference. Other reflector lamp configurations are known, for example, from U.S. Pat. Nos. 7,227,308, 6,162,096, 5,751,095, 5,629,581, 5,272,409 and 5,057,735 and U.S. Patent Application Publication Nos. 2005/0213332 and 2004/0120148.

BRIEF DESCRIPTION OF THE DRAWINGS

Reference should be made to the following detailed description which should be read in conjunction with the following figures, wherein like numerals represent like parts.

DETAILED DESCRIPTION

In general, a lamp assembly consistent with the present disclosure includes a spacer disk disposed in a lamp receptacle cavity between a lamp and the bottom of the lamp receptacle. The disk may be configured to contact connector clips coupled to the bottom of the lamp assembly to positively align the clips for connection to a ballast circuit. The disk may also, or alternatively, at least partially occlude connector clip openings in the bottom of the lamp receptacle for hindering the flow of uncured cement through the openings, and may also, or alternatively, provide a thermal barrier between the lamp and the lamp receptacle.

Figure 2:
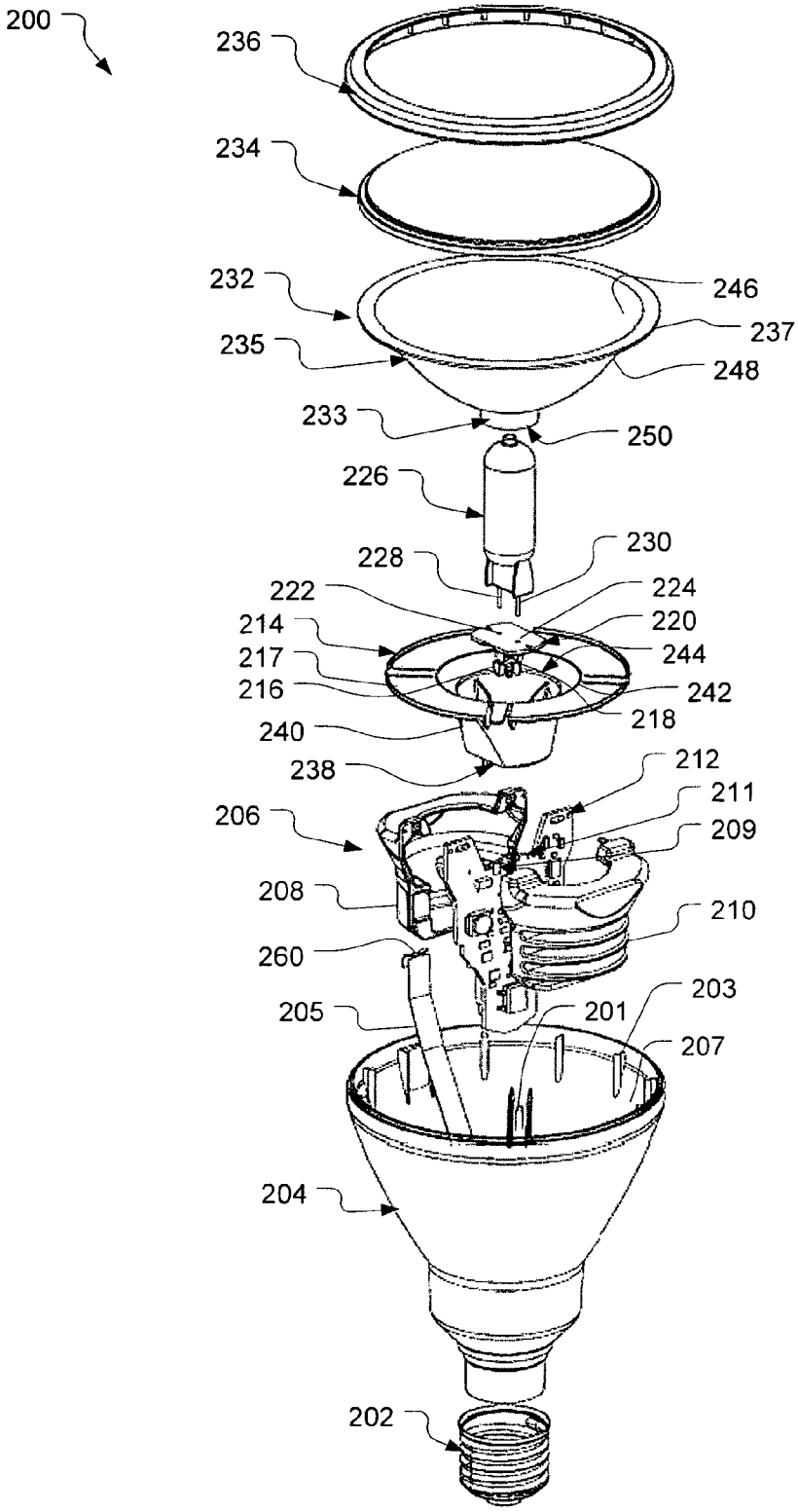
FIG. 2 is a exploded view of one embodiment of a lamp assembly consistent with the present disclosure.
Figure 3:
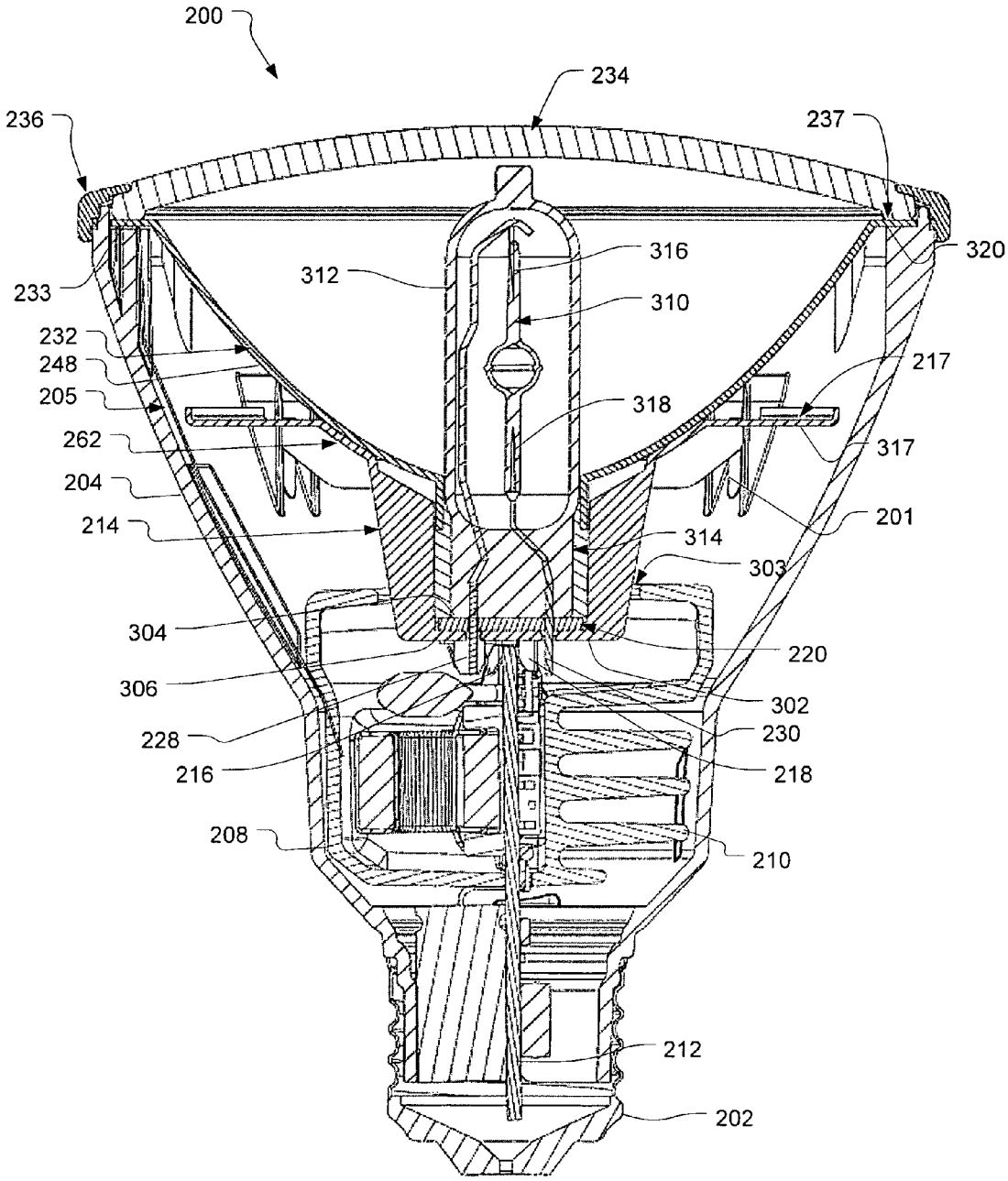
FIG. 3 is a sectional view of the lamp assembly illustrated in FIG. 2.

Turning now to FIGS. 2 and 3, an integrally ballasted lamp assembly 200 consistent with the present disclosure is shown in exploded and sectional views, respectively. As shown, the system 200 includes: includes a screw shell 202, a housing 204, an electro-magnetic interference (EMI) clip 205, a heat sink/EMI shield 206, a printed circuit board (PCB) with a ballast circuit thereon 212, a lamp receptacle 214, a spacer disk 220, connector clips 216,218, a reflector 232, a lamp 226, a lens 234 and a bezel 236.

Figure 1:
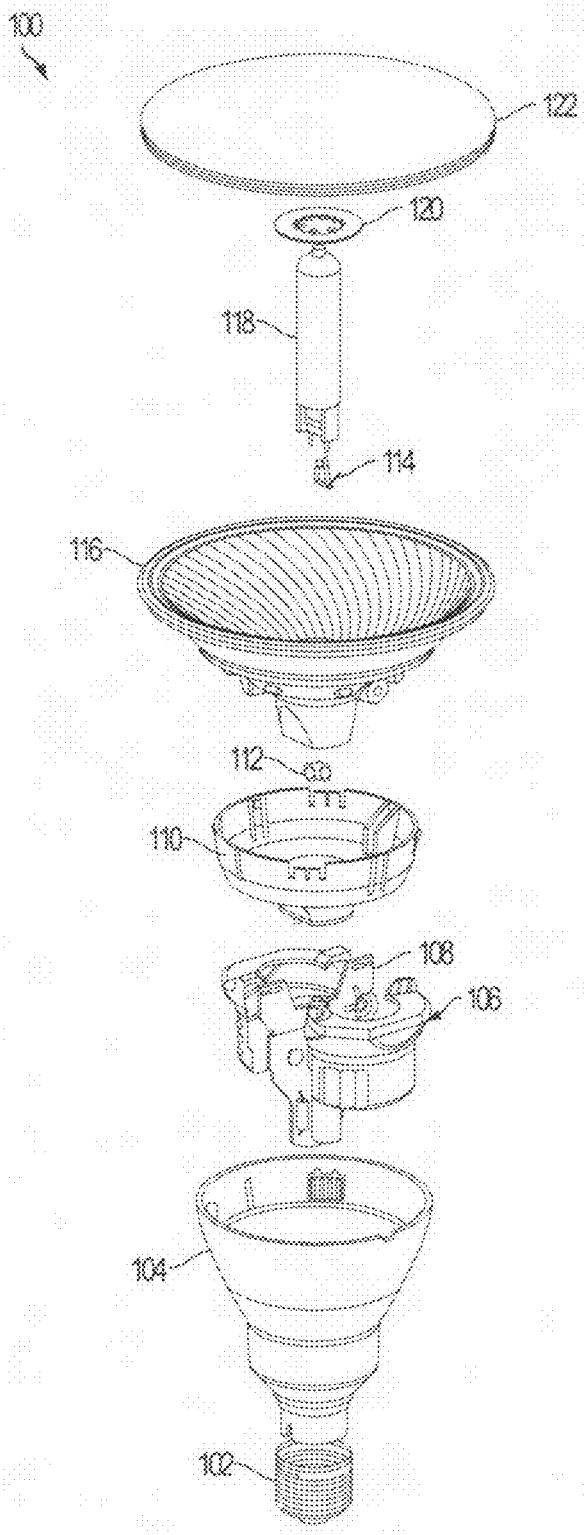
FIG. 1 PRIOR ART
FIG. 1 is an exploded view of a prior art lamp assembly.

The screw shell 202, PCB with the ballast circuit thereon 212 and the heat sink/EMI shield 206 may be fit into the housing 204 with the outputs of the PCB, e.g. at contact portions of The 209, 211 PCB, coupled to electrical leads 228, 230 of the lamp through the connector clips 216, 218 in a known manner, e.g. as shown in FIG. 1 and as described in U.S. Patent Application Publication No. US 2009/0279310, which has been incorporated herein by reference. In general, the PCB with the ballast circuit thereon 212 may be provided within the housing and electrically coupled to the screw shell 202 or "threaded base." The screw shell is configured to be received within an existing light fixture through threaded engagement of the threads on the screw shell with corresponding threads on the existing lighting fixture. An electrical input may thereby be coupled from the lighting fixture to the ballast circuit on the PCB through the screw shell. The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to physical connections or couplings is a relative term and does not require a direct physical connection.

The outputs of the ballast circuit on the PCB may be provided on opposite sides of the respective contact portions 209, 211 of the PCB, and may be coupled to respective electrical leads 228, 230 of the lamp by the connector clips 216, 218. The lamp 226 may take any known gas discharge lamp configuration, such as a high intensity discharge (HID) lamp. As shown particularly in FIG. 3, the lamp 226 in the illustrated exemplary embodiment includes a discharge tube 310 disposed within an outer sealed glass envelope or jacket 312. The outer jacket is affixed to press member or "press" 314, also commonly referred to as the "press seal region." The electrical leads 228, 230 are sealed into and pass through the press 314, and are coupled to electrodes 316, 318 at respective ends of the discharge tube 310. The electrodes project into the interior of the discharge tube. The ballast provides an electrical signal to the electrodes through the connector clips 216, 218 and the electrical leads 228, 230 for establishing arc discharge in the arc tube whereby light is emitted from the lamp.

The ballast circuit on the PCB may take any known configuration for driving the lamp. In the illustrated embodiment the screw shell 202 and ballast circuit on the PCB may be configured for connection to an alternating current (AC) main power source, e.g. 120V AC at 60 Hz, for driving an AC lamp configuration. It is to be understood, however, that the ballast circuit may operate from a direct current (DC) main power source, e.g. a vehicle battery, and/or the ballast may drive a DC lamp configuration. Also, the screw shell 202 may be replaced by an alternative configuration, such as a bayonet connector, adapted to connect to the power source.

The heat sink/EMI shield 206 may be provided in first 208 and second 210 parts that are fastened around the PCB 212 and mechanically coupled thereto. Heat generated by the ballast circuit during operation is dissipated by the heat sink/EMI shield 206. The heat sink/EMI shield also provides shielding of electro-magnetic interference (EMI) from the ballast circuit. In an embodiment where the reflector 232 is a metallic element, additional EMI shielding may be provided by the EMI clip 205. The EMI clip 205 may be a metallic element, e.g. a 302 stainless steel, and may be coupled to the interior surface 207 of the housing 204 for electrically coupling the heat sink/EMI shield 206 and the reflector 232. In such an embodiment the EMI clip 205, shields EMI received by the metallic reflector from the ballast electronics.

Figure 4:
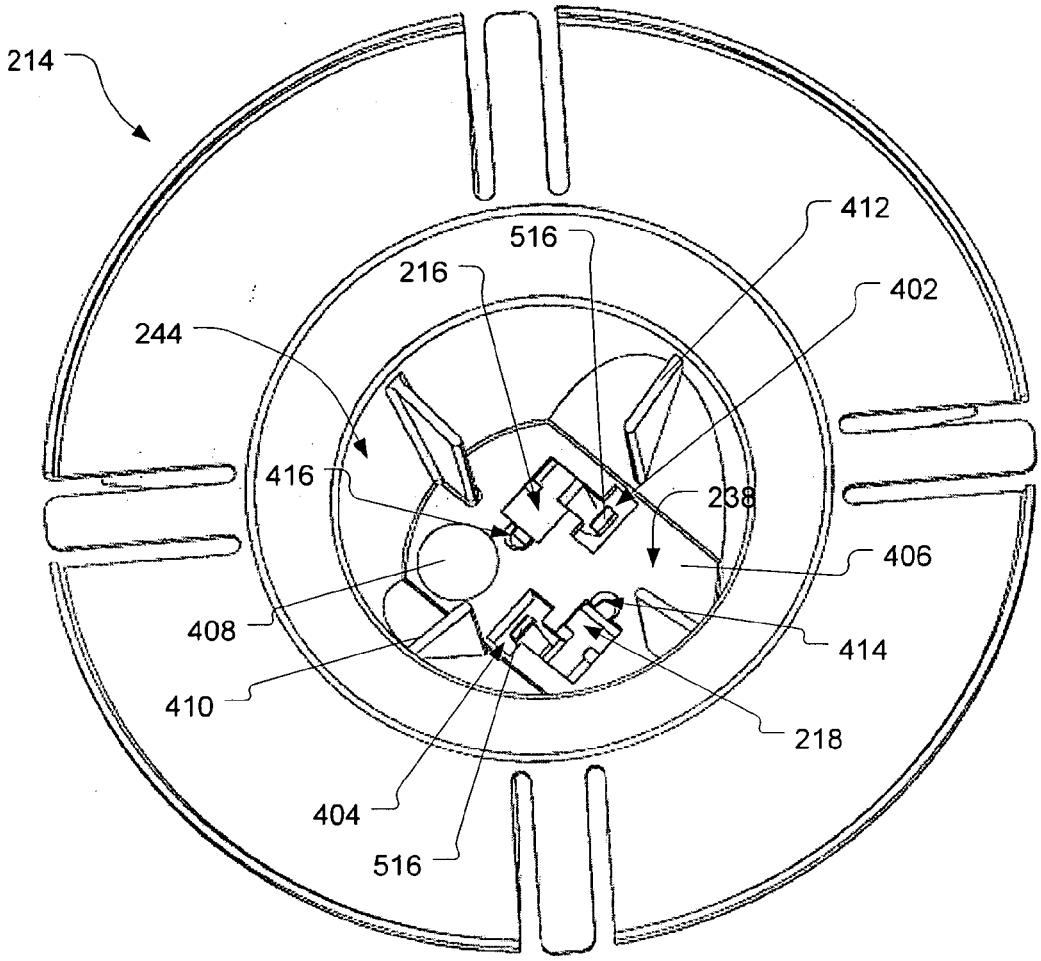
FIG. 4 is a top perspective view the lamp receptacle and connector clips shown in FIG. 2.

With the heat sink/EMI shield disposed around the PCB, an opening 303 is defined in the top of the heat sink/EMI shield for receiving a bottom portion of the lamp receptacle 214, as shown in FIG. 3. The lamp receptacle includes a bottom 238 and a wall portion 240 extending from the bottom to define a cavity 244 having an open end 242. With reference also to FIG. 3 and FIG. 4, the bottom has an interior surface 406 and an exterior surface 302 and first 402 and second 404 connector clip openings extending therethrough. The connector clips 216, 218 may be inserted into the connector clip openings 402, 404, respectively through the cavity 244.

Figure 5:
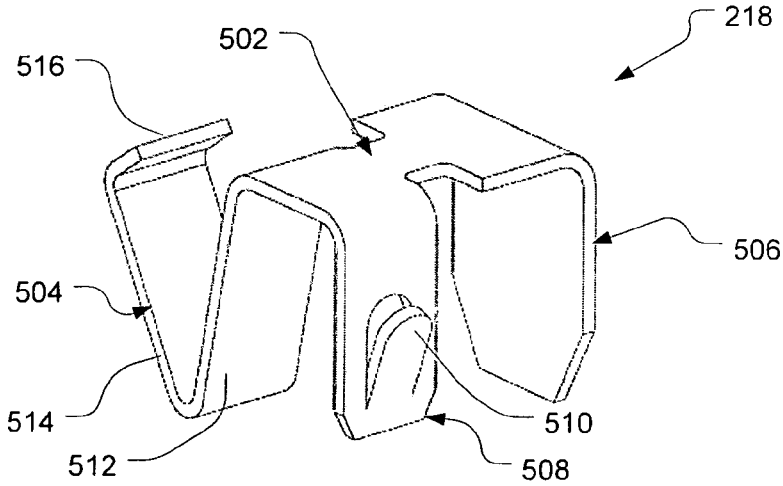
FIG. 5 is a perspective view of one of the connector clips shown in FIG. 2.

FIG. 5 is a perspective view of one of the connector clips 218, it being understood that both connector clips may take the same configuration. In the illustrated embodiment, the connector clip 218 is a metallic conductive element, including a base portion 502 configured to rest against the interior surface 406 of the bottom of the receptacle. The connector clip also includes a spring contact portion 504, a lamp lead contact portion 506 and a spring detent portion 508, each of which extends through the associated connector clip opening to extend outwardly from the bottom 238 of the lamp receptacle.

The spring detent portion 508 includes a detent 510, and is configured to deflect inwardly upon insertion of the connector clip into the connector clip opening. Once the detent 510 passes through the opening, the spring detent portion 508 extends outwardly to position the top of the detent 508 adjacent the exterior surface 302 of the bottom of the lamp receptacle. The connector clip is thus snap-fit to the lamp receptacle and may be removed by deflecting the spring detent portion 508 inwardly and forcing the connector clip out of the connector clip opening 402,404 in the direction of the open end 242 of the lamp receptacle.

The lamp lead contact portion 506 of the connector clip may be configured as a generally flat surface extending downwardly at approximately a right angle from the base portion 502, and may be positioned adjacent a lamp lead portion 414, 416 of the connector clip opening. When the lamp is assembled to the lamp receptacle, one of the electrical leads 228, 230 passes through an associated lamp lead portion 414, 416 and is positioned adjacent to a lamp lead contact portion 506 of a connector clip. The lamp lead may be welded or otherwise electrically coupled to the lamp lead portion.

Figure 8:
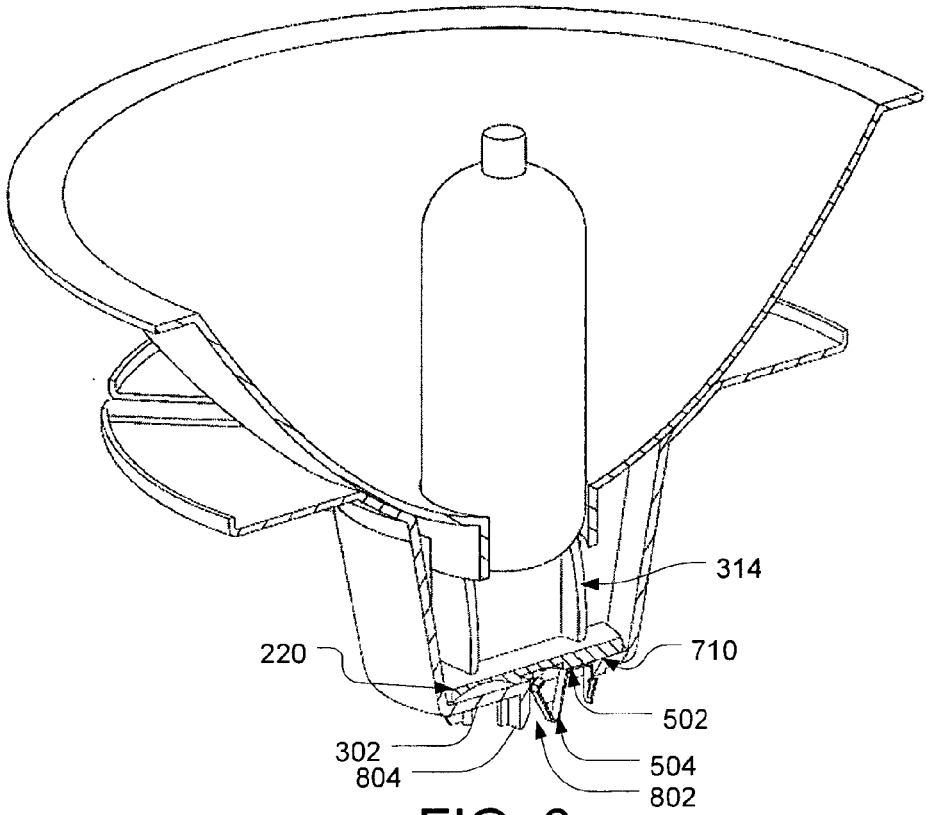
FIG. 8 is a perspective, sectional view of a portion of the lamp assembly shown in FIG. 2 without cement disposed in the lamp receptacle.
Figure 9:
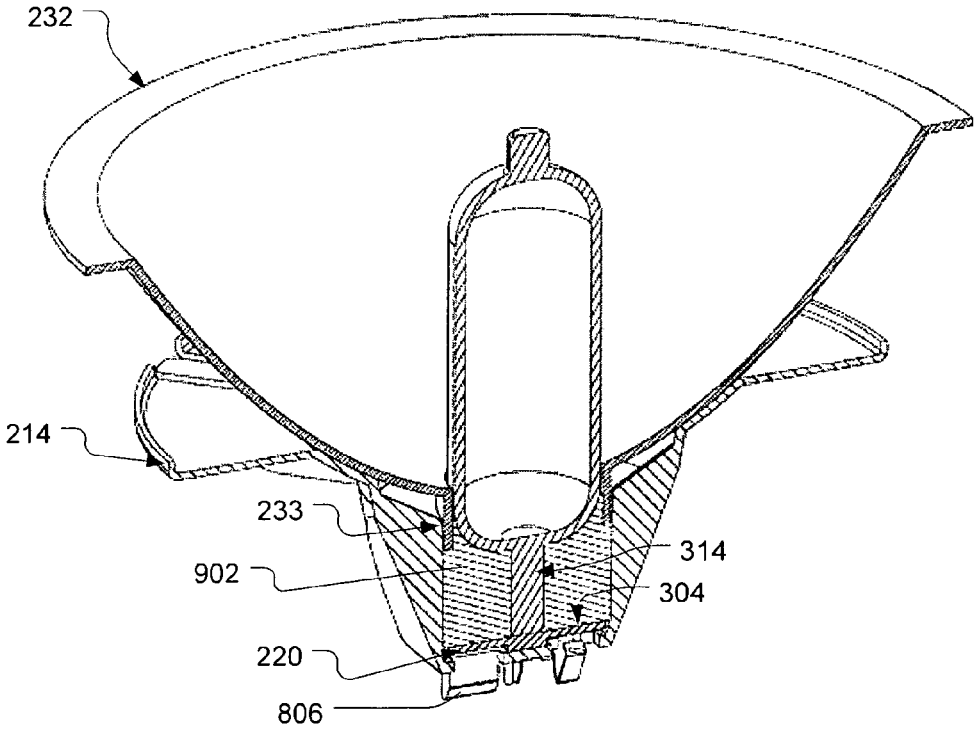
FIG. 9 is a perspective, sectional view of a portion of the lamp assembly shown in FIG. 2 with cement disposed in the lamp receptacle.

The spring contact portion 504 may be generally v-shaped with a first arm 512 extending downward from the base portion 502 and a second arm 514 extending upward from an end of the first arm 512 to a free end 516. With reference also to FIGS. 2 and 8-9, electrical connection between contacts on opposed sides of the respective contact portions 209, 211 of the PCB and the connector clips is established by positioning contact portions 209, 211 of the PCB in a space 802 between the spring contact portions 504 and the associated tabs 804, 806 extending from the exterior surface 302 of the bottom 238 of the lamp receptacle 214. The spring contact portions 504 are forced outwardly and against the contacts on the contact portions 209, 211 of the PCB to electrically couple output of the ballast circuit on the PCB to the connector clips 216, 218. The connector clips thus establish an electrical connection between the contacts on the PCB and the electrical leads of the lamp whereby the output from the ballast on the PCB may be provided to the lamp for establishing arc discharge in the arc tube whereby light is emitted from the lamp.

With reference again to FIGS. 2-3, the wall portion 240 of the lamp receptacle may terminate in an outwardly extending generally annular flange 217. The bottom surface 317 of the flange 217 may be supported in the housing by supports 201 extending inwardly from the interior surface 207 of the housing, e.g. spaced by 90 degrees from each other around the interior circumference of the housing. The lamp receptacle 214 may be a molded plastic component. A variety of plastic materials may be used to form the lamp receptacle. In one embodiment, the lamp receptacle may be molded from a liquid crystal polymer, such as a model number Vectra L130LCP liquid crystal polymer, presently available from Ticona Plastics of Florence, Ky., USA, to provide efficient dissipation of heat generated by the lamp and the electronics on the PCB.

The reflector 232 may include a base portion 233 and an upper portion 235. In the upper portion 235, an interior surface 246 of the reflector may define generally upwardly concave shape, such as a parabolic shape as provided, for example, in a known parabolic aluminized reflector (PAR) lamp. The interior surface 246 of the reflector in the upper portion 235 is configured for reflecting light emitted by the lamp outwardly from the lamp and through the lens 234.

The top of the upper portion 235 of the reflector may terminate in an outwardly extending generally annular flange 237. The bottom surface 320 of the flange 237 may be supported in the housing by supports 203 extending inwardly from interior surface 207 of the housing. In an embodiment wherein the reflector is a metallic element, the bottom surface 320 of the flange may contact a top 260 of the EMI clip 205 to electrically couple the reflector to the heat sink/EMI shield for shielding EMI imparted to the reflector. As shown particularly in FIG. 3, the exterior surface 248 of the reflector may also be supported in the housing by contact with a support portion 262 of the receptacle wall 240.

The upper portion 235 of the reflector may include a generally circular opening defining a through-passage 250. The base portion 233 of the reflector may be generally cylindrical and may extend downwardly from the upper portion 235 in alignment with the opening so that the through-passage 250 extends through the base portion 233. The base portion 233 may be dimensioned to extend into the cavity 244 in the lamp receptacle 214 so that the through-passage 250 in the reflector opens into the cavity 244.

A bottom portion of the lamp, e.g. the press 314, may extend at least partially through the through-passage 250 and into the cavity 244 in the lamp receptacle 214 for connecting the electrical leads 228, 230 of the lamp to the connector clips 216, 218. A top portion of the lamp, e.g. at least a portion of the outer jacket portion 312 and the discharge tube 310, may be positioned on the inside of the reflector. The lens 234 may be positioned over the open end of the housing 204, e.g. with a base portion 233 of the lens in contact with the flange 237 on the reflector. The lens may be a known glass or plastic element for allowing light emitted by the lamp to pass outwardly from the assembly for providing illumination. The lens may be secured to the housing in a known manner by the bezel 236.

In an assembly consistent with the present disclosure, the spacer disk 220 is disposed in the cavity 244 of the lamp receptacle 214 as a spacer between the lamp 226 and the bottom 238 of the lamp receptacle. The bottom surface 306 of the spacer disk is positioned adjacent to, or in contact with, the interior surface 406 of the bottom 238 of the lamp receptacle 214. In the illustrated embodiment, the spacer disk 220 includes first 222 and second 224 lamp lead openings. The electrical leads 228, 230 of the lamp extend through the lamp lead openings 222, 224 of spacer disk 220 and then through lamp lead portions 414, 416 of the connector clip openings for connection to the respective lamp lead portions 506 of the connector clips.

Figure 6:
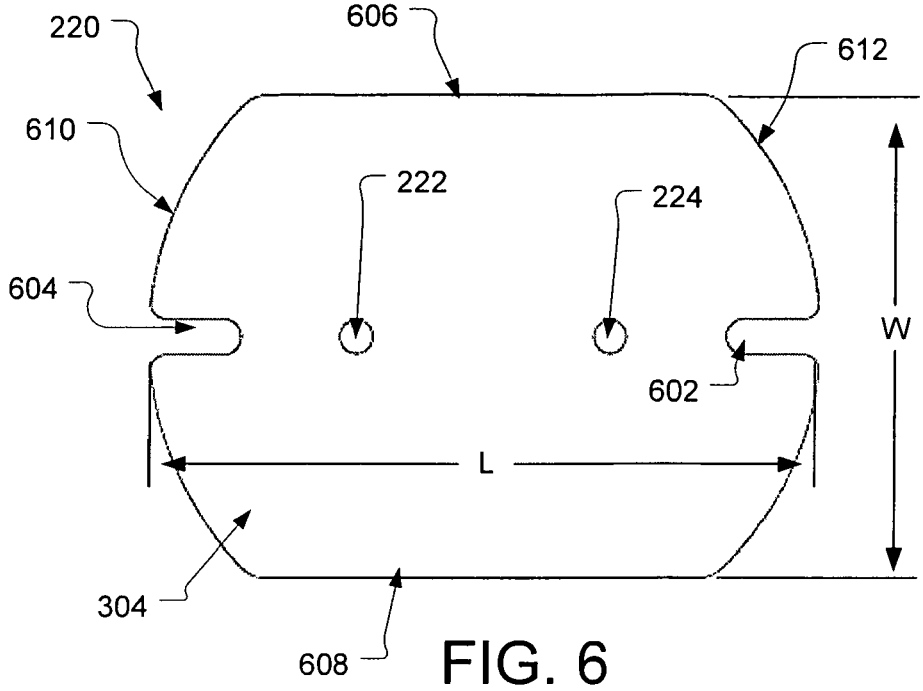
FIG. 6 is a top plan view of one embodiment of the spacer disk shown in FIG. 2.

As shown in FIG. 6, the spacer disk includes a generally flat top surface 304. It is to be understood, however, that the top surface 304 of the spacer disk may be contoured. The spacer disk may be dimensioned to conform to the dimensions of the interior surface 406 of the bottom 238 of the receptacle. In the illustrated exemplary embodiment, the spacer disk 220 is generally rectangular with opposed straight edges 606, 608, and opposed arcuate edges 610, 612. The disk 220 has a length L greater than a width W, and the opposed arcuate edges define an arc of a circle having a diameter of approximately ½ L. In one embodiment, the length L may be about 0.75", the width W may be about 0.5" and the disk may have a thickness T, shown in FIG. 7, of about 0.0625". The disk may be a molded plastic component molded from, for example, a model number Vectra L130LCP liquid crystal polymer, presently available from Ticona Plastics of Florence, Ky., USA. Although the spacer disk 220 is illustrated and described herein as having a specific shape and dimensions, it is to be understood that the spacer disk may take a variety of shapes depending, for example, upon the shape of the bottom portion of the lamp receptacle.

The spacer disk may include at least one feature configured to mate with a corresponding feature of the wall portion for fixing a position of the spacer disk in the cavity 244. In the illustrated embodiment, for example, the spacer disk includes portions defining first 602 and second slots 604 in the opposed arcuate edges 610, 612 thereof. The slots 602, 604 may be configured to receive first 410 and second 412 tabs, respectively, extending inwardly from the wall portion toward the cavity 244, as shown in FIG. 4. The spacer disk 220 may thus be inserted into the cavity 244 by aligning the slots 602, 604 with tabs 410,412 and sliding the spacer disk down toward the bottom 238 of the receptacle to thereby fix the position of the spacer disk within the cavity. Although the illustrated embodiment includes two slots in the spacer disk and two associated tabs in the lamp receptacle, any number of mating features may be provided in any portion of the spacer disk and the lamp receptacle. For example, one or more slots may be provided in the lamp receptacle with one or more tabs provided on the spacer disk. Other mating shapes, e.g. rectangular or circular, may be provided for establishing a mating connection between the spacer disk and the lamp receptacle.

Figure 7:
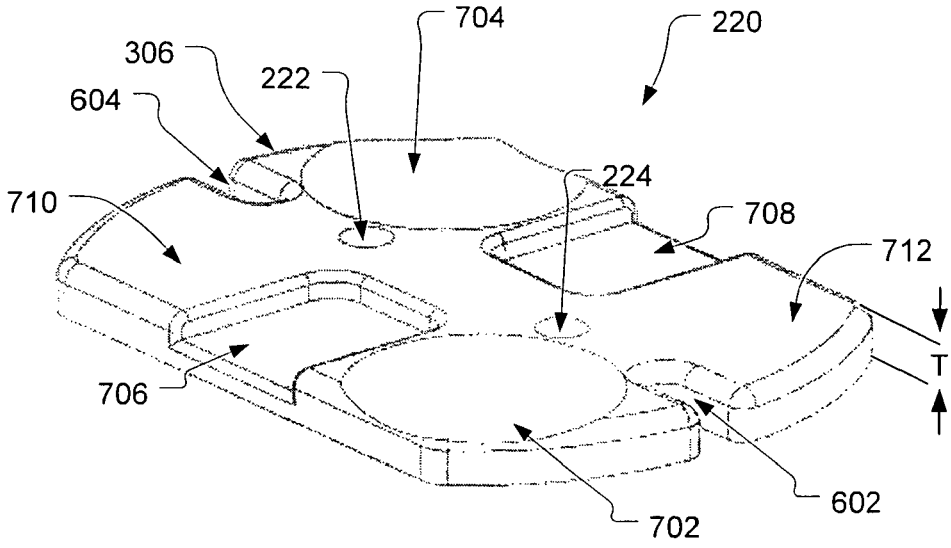
FIG. 7 is a bottom perspective view of the spacer disk illustrated in FIG. 2.

The bottom surface 306 of the spacer disk may contact the interior surface 406 of the bottom 238 of the receptacle and may include at least one feature configured to mate with a corresponding feature of said interior surface of said bottom of said lamp receptacle. As shown in FIG. 7, for example, the spacer disk may include concavities 702,704 in the bottom surface thereof. At least one of the concavities may be positioned and configured to receive a corresponding convex projection 408 (FIG. 4) on the interior surface 406 of the bottom of the lamp receptacle 214. Mating of the concavity with the projection resists movement of the spacer disk relative to the receptacle. Although the illustrated embodiment includes two concavities in the spacer disk and one convex projection, any number of mating features may be provided in any portion of the spacer disk and the bottom of the lamp receptacle. For example, one or more concavities may be provided in the bottom of the lamp receptacle with one or more projections provided on the spacer disk. Other mating shapes, e.g. rectangular or circular, may be provided for establishing a mating connection between the spacer disk and the lamp receptacle.

In the illustrated exemplary embodiment at FIGS. 6 to 7, the bottom surface 306 of the spacer disk includes first 706 and second 708 rectangular notches that respectively intersect the opposed straight edges 606, 608 thereof. The notches may be positioned to align with portions of the connector clip openings 402, 404 through with the spring contact portions 504 of the connector clips extend. The notches may allow upward movement of the spring contact portions 504 through the connector clip openings when the PCB board is forced into contact with the spring contact portions 504 of the connector clips.

The bottom surface 306 of the spacer disk 220 may also include first 710 and second 712 generally flat portions. The flat portions 710, 712 may be positioned for directly contacting the base portions 502 of the first 216 and second 218 connector clips, respectively. As shown for example in FIG. 8, contact between the flat portion 710 of the bottom surface 306 of the spacer disk and the base portion 502 of the connector clips provides a downward force on the connector clips when the lamp leads are installed through the lamp lead openings.

In the efforts leading to the embodiments disclosed herein it has been discovered that the connector clips 216, 218 may fit only loosely in the connector clip openings 402, 404 and may be free to move out of alignment with the contacts portions 209, 211 on the PCB board, resulting in a cumbersome assembly process. The downward force imparted by contact of the bottom surface 306 of the spacer disk 220 with the base portions 502 of the connector clips resists movement of the connector clips in the connector clip openings. This tends to force the connector clips into more positive alignment with the contacts portions of the PCB, allowing for facile coupling of the contacts on the PCB to the connector clips.

It has also been discovered that as the overall dimensions of the lamp assembly are decreased heat generated by the lamp and the electronics on the PCB may not be adequately dissipated by the heat sink 206. To dissipate heat, a cement 902 may be provided on the top surface 304 of the spacer disk 220 in the cavity 244, as shown in FIG. 9. The cement may, for example, be a cement such as model #13 or #29 cement presently available from Sauereisen, Inc. of Pittsburgh, Pa., USA.

In one embodiment, the reflector may be a metallic reflector made from, for example, a 1090 aluminum with a clear anodized coating on an interior surface thereof. The base portion 233 of the reflector 232 may be inserted into the cavity of the lamp receptacle as shown. The cement 902 may be inserted into the cavity in an uncured state, and then cured, e.g. thermally. As shown in FIG. 9, the cured cement 902 may thus couple the reflector, e.g. the base portion 233 thereof, to the lamp receptacle 214 for dissipating heat from the lamp and/or ballast circuit on the PCB.

In an assembly consistent with the present disclosure, the spacer disk may be disposed within the lamp receptacle cavity 244 for at least partially occluding the first 402 and second 404 connector clip openings to hinder the cement 902 from passing through said first and second connector clip openings when the cement is in an uncured state. In the illustrated exemplary embodiment, the spacer disk generally conforms to the dimensions of the interior surface 406 of the bottom 238 of the lamp receptacle 214 and covers the connector clip openings, except for the lamp lead portions 414, 416 thereof which are in alignment with the lamp lead openings 222, 224 in spacer disk 220. The presence of the lamp leads 228, 230 in the lamp lead openings 222, 224 may at least partially occlude the lamp lead portions 414, 416 of the connector clip openings. Consistent with the present disclosure therefore the spacer disk 220 hinders the cement 902 from passing through the connector clip openings in an uncured state of the cement, and may, but does not necessarily, prevent all cement from passing through the openings.

The presence of the spacer disk between the lamp and the bottom of the lamp receptacle may also act as a thermal barrier. A portion of the heat generated by the ballast circuit may be blocked from the cavity by the spacer disk, and a portion of the heat generated by the lamp may be blocked from the PCB by the spacer disk. In an embodiment where the uncured cement is provided in the cavity and the spacer disk provides a downward force on the connector clips and at least partially occludes the connector clip openings, the spacer disk realizes one or more of the following advantages in that it more positively aligns the connector clips, hinders uncured cement from passing through the connector clip openings, and presents a thermal barrier. The spacer disk thus allows for facile assembly of a lamp assembly consistent with the present disclosure while facilitating a construction that allows for dissipation of heat.

Figure 10:
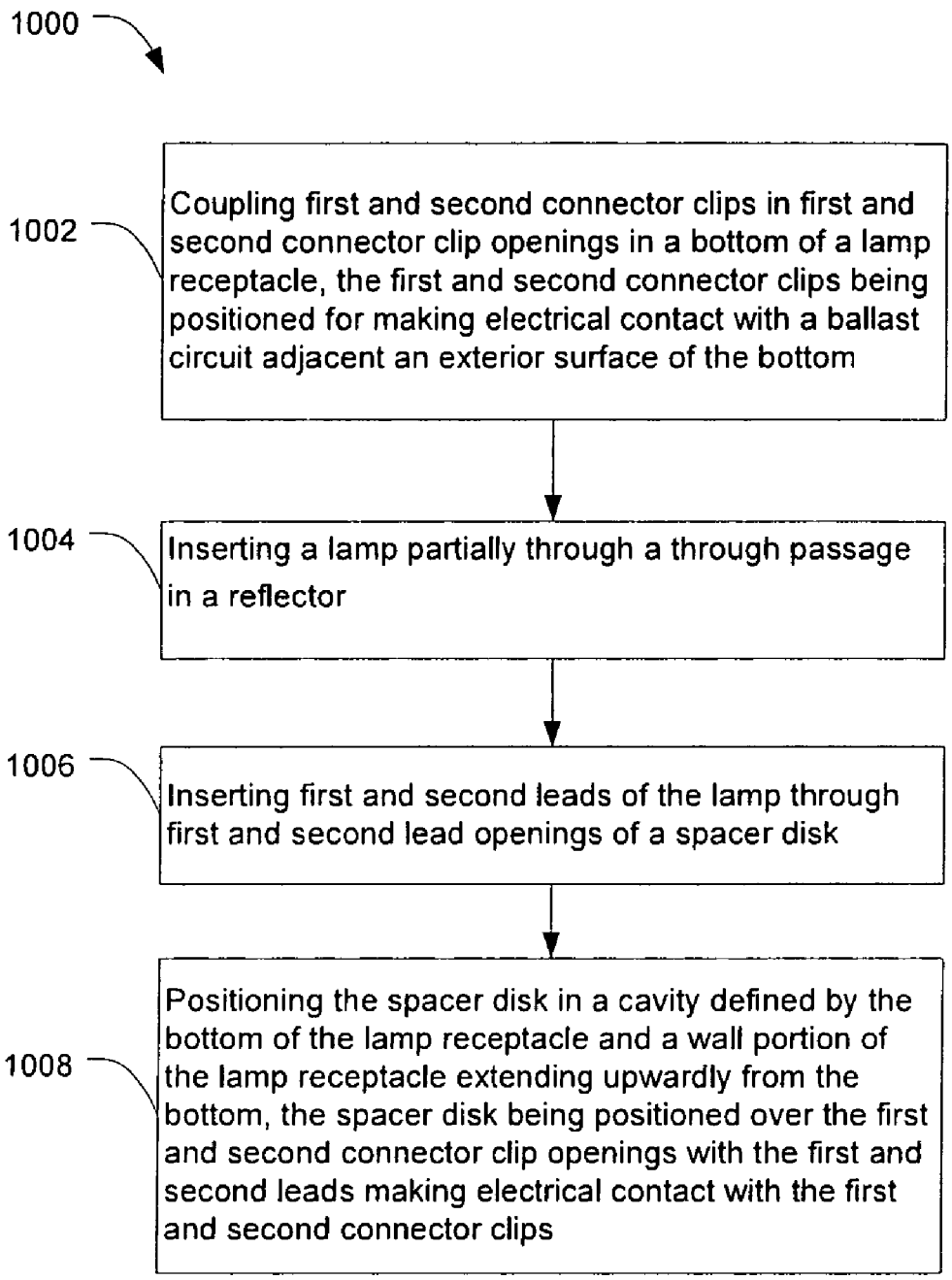
FIG. 10 is a block flow diagram of one exemplary method consistent with the present disclosure.

FIG. 10 is a block flow diagram of one method 1000 of assembling a lamp consistent with the present disclosure. The illustrated block flow diagram may be shown and described as including a particular sequence of steps that may be implemented in the illustrated order. It is to be understood, however, that the sequence of steps merely provides an example of how the general functionality described herein can be implemented. The steps do not have to be executed in the order presented unless otherwise indicated.

In the exemplary embodiment illustrated in FIG. 10, first and second connector clips are coupled 1002 in first and second connector clip openings in the bottom of the lamp receptacle, the first and second connector clips being positioned for making electrical contact with a ballast circuit adjacent an exterior surface of the bottom. A lamp is inserted 1004 partially through a through-passage in a reflector. First and second leads of the lamp are inserted 1006 through first and second lead openings of a spacer disk. The spacer disk is positioned 1008 in a cavity defined by the bottom of the lamp receptacle and a wall portion of the lamp receptacle extending upwardly from the bottom, the spacer disk being positioned over the first and second connector clip openings with the first and second leads making electrical contact with the respective first and second connector clips.

According to one aspect of the present disclosure, there is thus provided a lamp assembly including a lamp receptacle including a bottom and a wall portion extending from the bottom to define a cavity having an open end, the bottom having an interior surface and an exterior surface and first and second connector clip openings extending therethrough; first and second connector clips coupled to the bottom of the lamp receptacle and disposed in the first and second connector clip openings, respectively, for making electrical contact with a ballast circuit adjacent the exterior surface of the bottom; a spacer disk having a top surface and a bottom surface, the spacer disk being disposed in the cavity with the bottom surface of the spacer disk being positioned adjacent the interior surface of the bottom of the lamp receptacle, the spacer disk having first and second lamp lead openings extending therethrough; a reflector having a through-passage; and a lamp including first and second electrical leads. A portion of the lamp extends through the through-passage and into the cavity of the lamp receptacle with the first and second electrical leads extending through the first and second lamp lead openings, respectively, and being electrically connected to the first and second connector clips, respectively.

According to another aspect of the present disclosure, there is thus provided a method of assembling a lamp including:

coupling first and second connector clips in first and second connector clip openings in a bottom of a lamp receptacle, the first and second connector clips being positioned for making electrical contact with a ballast circuit adjacent an exterior surface of the bottom; inserting a lamp partially through a through-passage in a reflector; inserting first and second leads of the lamp through first and second lead openings of a spacer disk; and positioning the spacer disk in a cavity defined by the bottom of the lamp receptacle and a wall portion of the lamp receptacle extending upwardly from the bottom, the spacer disk being positioned over the first and second connector clip openings with the first and second leads making electrical contact with the first and second connector clips.

According to another aspect of the disclosure, there is provided a lamp assembly including: a lamp receptacle including a bottom and a wall portion extending from the bottom to define a cavity having an open end, the bottom having an interior surface and an exterior surface and first and second connector clip openings extending therethrough; first and second connector clips coupled to the bottom of the lamp receptacle and disposed in the first and second connector clip openings, respectively, for making electrical contact with a ballast circuit adjacent the exterior surface of the bottom; a spacer disk having a top surface and a bottom surface, the spacer disk being disposed in the cavity with the bottom surface of the spacer disk being positioned adjacent the interior surface of the bottom of the lamp receptacle, the spacer disk having first and second lamp lead openings extending therethrough; a reflector having a through-passage; a lamp including first and second electrical leads, a portion of the lamp extending through the through-passage and into the cavity of the lamp receptacle, the first and second electrical leads extending through the first and second lamp lead openings, respectively, and being electrically connected to the first and second connector clips, respectively; and a cement disposed in the cavity on the top surface of the spacer disk and being coupled to the base portion of the reflector for securing the reflector to the lamp receptacle. The spacer disk is disposed in the cavity at least partially occluding the first and second connector clip openings to hinder the cement from passing through the first and second connector clip openings when the cement is in an uncured state. It is preferred that the spacer disk is also in contact with the first and second connector clips to resist movement of the first and second connector clips in the first and second connector clip openings, respectively.

While the principles of the invention have been described herein, it is to be understood by those skilled in the art that this description is made only by way of example and not as a limitation as to the scope of the invention. Reference numerals corresponding to the embodiments described herein may be provided in the following claims as a means of convenient reference to the examples of the claimed subject matter shown in the drawings. It is to be understood however, that the reference numerals are not intended to limit the scope of the claims. Other embodiments are contemplated within the scope of the present invention in addition to the exemplary embodiments shown and described herein. Modifications and substitutions by one of ordinary skill in the art are considered to be within the scope of the present invention, which is not to be limited except by the recitations of the following claims.

Following is a non-limiting list of reference numerals used in the drawings of the present disclosure:

| | |
|---|---|
| 100 | Integrally ballasted lamp assembly |
| 102 | Screw shell |
| 104 | Housing |
| 106 | Heat sink/EMI shield |
| 108 | Printed circuit board (PCB) with a ballast circuit thereon |
| 110 | Lamp receptacle |
| 112, 114 | Connector clips |
| 116 | Glass reflector |
| 118 | Gas discharge lamp |
| 120 | Support disk |
| 122 | Lens |
| 200 | Integrally ballasted lamp assembly |
| 201 | Supports |
| 202 | Screw shell |
| 203 | Supports |
| 204 | Housing |
| 205 | Electro-magnetic interference (EMI) clip |
| 206 | Heat sink/EMI shield |
| 207 | Interior surface |
| 208 | First part |
| 209, 211 | Contact portions of the PCB |
| 210 | Second part |
| 212 | Printed circuit board (PCB) with a ballast circuit thereon |
| 214 | Lamp receptacle |
| 216, 218 | Connector clips |
| 217 | Annular flange |
| 220 | Spacer disk |
| 222 | First lamp lead opening |
| 224 | Second lamp lead openings |
| 226 | lamp |
| 228, 230 | Electrical leads |
| 232 | Reflector |
| 233 | Base portion |
| 234 | Lens |
| 235 | Upper portion |
| 236 | Bezel |
| 237 | Annular flange |
| 238 | Bottom of the lamp receptacle |
| 240 | Wall portion |
| 240 | Receptacle wall |
| 242 | Open end |
| 244 | Cavity |
| 246 | Interior surface |
| 248 | Exterior surface |
| 250 | Passage |
| 260 | Top of the EMI clip |
| 262 | Support portion |
| 302 | Exterior surface |
| 303 | Opening |
| 304 | Flat top surface |
| 306 | Bottom surface |
| 310 | Discharge tube |
| 312 | Outer sealed glass envelope or jacket |
| 314 | Press or "press seal region" |
| 316, 318 | Electrodes |
| 317 | Bottom surface |
| 320 | Bottom surface |
| 402 | First connector clip opening |
| 404 | Second connector clip opening |
| 406 | Interior surface |
| 408 | Convex projection |
| 410 | First tab |
| 412 | Second tab |
| 414, 416 | Lamp lead portion |
| 502 | Base portion |
| 504 | Spring contact portion |
| 506 | Lamp lead contact portion |
| 508 | Spring detect portion |
| 510 | Detent |
| 512 | First arm |
| 514 | Second arm |
| 516 | Free end |
| 602 | First slot |
| 604 | Second slot |
| 606, 608 | Straight edges |
| 610, 612 | Arcuate edges |

-continued

| | |
|---|---|
| 702, 704 | Concavities |
| 706 | First rectangular notches |
| 708 | Second rectangular notches |
| 710 | First generally flat portion |
| 712 | Second generally flat portion |
| 802 | Space |
| 804, 806 | Tabs |
| 902 | Cement |
| 1000 | Method of assembling a lamp |
| 1002 | First and second connector clips are coupled |
| 1004 | Lamp is inserted |
| 1006 | First and second leads of the lamp are inserted |
| 1008 | Spacer disk is positioned |

What is claimed is:

1. A lamp assembly comprising:

a lamp receptacle (214) including a bottom (238) and a wall portion (240) extending from said bottom to define a cavity (244) having an open end (242), said bottom having an interior surface (406) and an exterior surface (302) and first (402) and second (404) connector clip openings extending therethrough;

first (216) and second (218) connector clips coupled to said bottom of said lamp receptacle and disposed in said first and second connector clip openings, respectively, for making electrical contact with a ballast circuit (212) adjacent said exterior surface of said bottom;

a spacer disk (220) having a top surface (304) and a bottom surface (306), said spacer disk being disposed in said cavity with said bottom surface of said spacer disk being positioned adjacent said interior surface of said bottom of said lamp receptacle, said spacer disk having first (222) and second (224) lamp lead openings extending therethrough;

a reflector (232) having a through-passage (250); and a lamp (226) including first (228) and second (230) electrical leads, a portion (314) of said lamp extending through said through-passage and into said cavity of said lamp receptacle, said first and second electrical leads extending through said first and second lamp lead openings, respectively, and being electrically connected to said first and second connector clips, respectively.

2. A lamp assembly according to claim 1, said assembly further comprising a cement (902) disposed in said cavity (244) on said top surface (304) of said spacer disk (220).

3. A lamp assembly according to claim 2, wherein said spacer disk (220) is disposed at least partially occluding said first (402) and second (404) connector clip openings to hinder said cement (902) from passing through said first and second connector clip openings when said cement is in an uncured state.

4. A lamp assembly according to claim 2, wherein said cement (902) is coupled to said reflector (232) for securing said reflector to said lamp receptacle (214).

5. A lamp assembly according to claim 1, wherein said spacer disk (220) comprises at least one feature (602,604) configured to mate with a corresponding feature (410,412) of said wall portion (240) for fixing a position of said spacer disk in said cavity (244).

6. A lamp assembly according to claim 1, wherein said bottom surface (306) of said spacer disk (220) contacts said first (216) and second (218) connector clips to resist movement of said first and second connector clips in said first (402) and second (404) connector clip openings, respectively.

7. A lamp assembly according to claim 1, wherein said bottom surface (306) of said spacer disk (220) contacts said interior surface (406) of said bottom of said lamp receptacle (214).

8. A lamp assembly according to claim 1, wherein said bottom surface (306) of said spacer disk (220) includes at least one feature (702,704) configured to mate with a corresponding feature (408) of said interior surface (406) of said bottom of said lamp receptacle (214).

9. A method of assembling a lamp, comprising:

coupling first (216) and second (218) connector clips in first (402) and second (404) connector clip openings in a bottom (238) of a lamp receptacle (214), said first and second connector clips being positioned for making electrical contact with a ballast circuit (212) adjacent an exterior surface (302) of said bottom;

inserting a lamp (226) partially through a through-passage (250) in a reflector (232);

inserting first (228) and second (230) leads of said lamp (226) through first (222) and second (224) lead openings of a spacer disk (220); and positioning said spacer disk in a cavity (244) defined by said bottom of said lamp receptacle and a wall portion (240) of said lamp receptacle extending upwardly from said bottom, said spacer disk being positioned over said first and second connector clip openings with said first and second leads making electrical contact with said first and second connector clips.

10. A method according to claim 9, said method further comprising inserting a cement (902) into said cavity (244) on a top surface (304) of said spacer disk (220).

11. A method according to claim 10, wherein said positioning comprises positioning said spacer disk to at least partially occlude said first (402) and second (404) connector clip openings to hinder said cement (902) from passing through said first and second connector clip openings when said cement is in an uncured state.

12. A method according to claim 10, wherein said inserting said cement (902) comprises coupling said cement to said reflector (232) for securing said reflector to said lamp receptacle (214).

13. A method according to claim 9, wherein said positioning said spacer disk (220) comprises positioning said spacer disk against said first (216) and second (218) connector clips to resist movement of said first and second connector clips in said first (404) and second (404) connector clip openings, respectively.

14. A method according to claim 9, wherein said positioning said spacer disk (220) comprises positioning a bottom surface (306) of said spacer disk in contact with an interior surface (406) of said bottom of said lamp receptacle (214).

* * * * *